US010143075B2

(12) United States Patent
Teramoto et al.

(10) Patent No.: US 10,143,075 B2
(45) Date of Patent: Nov. 27, 2018

(54) DEVICE FOR EMITTING EXTREME ULTRAVIOLET LIGHT

(71) Applicant: USHIO DENKI KABUSHIKI KAISHA, Tokyo (JP)

(72) Inventors: Yusuke Teramoto, Gotenba (JP); Hideyuki Urakami, Himeji (JP); Akihisa Nagano, Gotenba (JP)

(73) Assignee: USHIO DENKI KABUSHIKI KAISHA, Tokyo (JP)

( * ) Notice: Subject to any disclaimer, the term of this patent is extended or adjusted under 35 U.S.C. 154(b) by 157 days.

(21) Appl. No.: 15/083,372

(22) Filed: Mar. 29, 2016

(65) Prior Publication Data

US 2016/0295674 A1 Oct. 6, 2016

(30) Foreign Application Priority Data

Mar. 31, 2015 (JP) ..... 2015-074231

(51) Int. Cl.
*H05G 2/00* (2006.01)

(52) U.S. Cl.
CPC ..... *H05G 2/008* (2013.01); *H05G 2/005* (2013.01)

(58) Field of Classification Search
CPC ..... H05G 2/003; H05G 2/005; H05G 2/008; H01J 1/88
See application file for complete search history.

(56) References Cited

U.S. PATENT DOCUMENTS 8,040,033 B2 10/2011 Zhokhavets et al.
2003/0006383 A1* 1/2003 Melnychuk ..... B82Y 10/00 250/504 R
2011/0133641 A1* 6/2011 Zhokhavets ..... H05G 2/003 313/631
2015/0371833 A1* 12/2015 Kato ..... C23C 14/0605 427/577

FOREIGN PATENT DOCUMENTS

JP 2010-539637 A 12/2010
WO 2009/031104 A1 3/2009

* cited by examiner

*Primary Examiner* — David E Smith
*Assistant Examiner* — Hsien Tsai
(74) *Attorney, Agent, or Firm* — Studebaker & Brackett PC

(57) ABSTRACT

An extreme ultraviolet light source device includes two discharge electrodes, two plasma raw material containers associated with the discharge electrodes, respectively, and two supply units associated with the containers, respectively. The supply units supply the plasma raw materials from the containers onto the discharge electrodes upon rotations of the discharge electrodes. The light source device also includes an energy beam irradiating unit configured to irradiate the plasma raw material on a circumferential surface of one of the discharge electrodes with an energy beam to vaporize the plasma raw material such that electric discharge takes place between the discharge electrodes to generate the plasma. The light source device also includes two film thickness regulating units associated with the discharge electrodes, respectively. Each film thickness regulating unit is configured to regulate a thickness of the plasma raw material on the circumferential surface of the associated discharge electrode to a predetermined film thickness.

18 Claims, 8 Drawing Sheets

DEVICE FOR EMITTING EXTREME ULTRAVIOLET LIGHT

FIELD OF THE INVENTION

The present invention relates to a light source device for emitting extreme ultraviolet light by electric discharge.

DESCRIPTION OF THE RELATED ART

In recent years, a wavelength of exposure light emitted from a light source is reduced with miniaturization and high integration of semiconductor integrated circuits. As a next-generation light source for semiconductor exposure, a light source device (hereinafter referred to also as an "EUV light source device") for emitting extreme ultraviolet light (hereinafter referred to also as "EUV light") particularly having a wavelength of 13.5 nm is developed.

The EUV light source device may use one of known methods to generate the EUV light. One of such methods includes heating and exciting an extreme ultraviolet light emission seed (EUV emission seed) to generate high-temperature plasma, and taking out the EUV light from the high-temperature plasma.

The EUV light source devices employing such methods are classified into an LPP (Laser Produced Plasma) type and a DPP (Discharge Produced Plasma) type, depending upon the employed method of generating the high-temperature plasma.

A DPP type EUV light source device applies a high voltage across a pair of electrodes, which is supplied with a discharge gas containing an extreme ultraviolet light emission seed, to generate high-density and high-temperature plasma upon electric discharge, and uses extreme ultraviolet light emitted therefrom. For use with the DPP type EUV light source device, a method has been proposed that includes supplying a surface of each electrode, which is used to generate electric discharge, with a raw material such as Sn (tin) or Li (lithium), and irradiating the raw material with an energy beam such as a laser beam for evaporation thereof such that high-temperature plasma is generated upon electric discharge. Such a method is sometimes referred to as an LDP (Laser Assisted Discharge Produced Plasma) method or an LDP type.

The LDP type EUV light source device includes a pair of discharge electrodes each made of, for example, a metallic disc-shaped member. Each discharge electrode is disposed so as to be partly soaked in the liquid raw material contained in a container. Each discharge electrode is rotated by a motor that is connected to a nearly central portion of the discharge electrode. The liquid raw materials adhering to the surfaces of the discharge electrodes are conveyed to a discharging region upon rotations of the discharge electrodes.

The raw material on the surface of each electrode to be conveyed to the discharging region must be regulated to have a predetermined thickness because the predetermined thickness is required to obtain a predetermined EUV output. For example, Japanese Patent Application Laid-Open Publication No. 2010-539637 discloses a mechanism for regulating the thickness of the raw material on the surface of the electrode. The film thickness regulating mechanism disclosed in Japanese Patent Application Laid-Open Publication No. 2010-539637 intends to wipe off a raw material from an outer circumferential surface of a disc-shaped discharge electrode using a wiper element to form a predetermined gap between the outer circumferential surface and the wiper element. In order to maintain a predetermined gap, the wiper element is pressed to the outer circumferential surface of the discharge electrode by a spring.

SUMMARY OF THE INVENTION

In the technique as disclosed in Japanese Patent Application Laid-Open Publication No. 2010-539637, a spring force (biasing force of the spring) is regulated to allow the raw material on the outer circumferential surface to have the predetermined thickness during steady rotation of the discharge electrode. The spring force is set such that the spring force becomes the same as a force that is exerted on the wiper element by a centrifugal force of the raw material on the electrode surface during the steady rotation of the discharge electrode. However, the force exerted on the wiper element by the centrifugal force of the raw material is less than the spring force during a period from when the discharge electrode is in a stationary state (rest state) to when the discharge electrodes rotates at a steady speed (maximum speed). Because of this, the wiper element is held in contact with the outer circumferential surface of the discharge electrode by the biasing force of the spring during the period from the stationary state of the discharge electrode to the steady rotation.

Accordingly, as the EUV light source device is activated and deactivated repeatedly (that is, rotations and stoppage of the discharge electrodes are repeated), each of the wiper elements abrades gradually through the contact thereof with the outer circumferential surface of the associated discharge electrode. The abrasion causes the spring to extend by an abrasion loss. Thus, during the steady rotation of the discharge electrode, the spring force becomes less than the force exerted on the wiper element by the centrifugal force of the raw material on the electrode surface. Accordingly, the thickness of the raw material on the outer circumferential surface of the discharge electrode becomes larger than a desired thickness. This causes the centrifugal force to scatter the raw material on the outer circumferential surface during rotation of the discharge electrode and brings about a risk of not being able to obtain a desired optical output from the EUV light source device because the raw material so scattered is likely to adhere to undesired portions within the EUV light source device and/or a vaporized raw material is excessively generated when the raw material on the discharge electrode is irradiated with an energy beam.

The present invention intends to provide an extreme ultraviolet light source device capable of maintaining a desired thickness of a high-temperature plasma raw material on each discharge electrode even when rotating and stopping of the discharge electrode are repeatedly conducted.

According to one aspect of the present invention, there is provided a light source device for emitting extreme ultraviolet light from plasma. The light source device includes a pair of disc-shaped rotatable discharge electrodes spaced from each other. Each discharge electrode has opposite circular surfaces and a circumferential surface lying between the opposite circular surfaces. The light source device also includes a power supply unit configured to supply the discharge electrodes with pulsed power, and a pair of containers associated with the two discharge electrodes, respectively. Each container is configured to contain a high-temperature plasma raw material therein. The raw material is a liquid raw material. The light source device also includes a pair of raw material supply units associated with the two containers, respectively. Each raw material supply unit is configured to supply the high-temperature plasma raw material from the associated container onto the associated discharge electrode by allowing a portion of the associated discharge electrode to pass through the high-temperature plasma raw material in the associated container upon rotations of the discharge electrode concerned. The light source device also includes an energy beam irradiating unit configured to irradiate the high-temperature plasma raw material on the circumferential surface of one of the two discharge electrodes with an energy beam to vaporize the high-temperature plasma raw material such that electric discharge takes place between the discharge electrodes to generate the plasma. Extreme ultraviolet light is generated from the plasma. The light source device also includes a pair of film thickness regulating units associated with the two discharge electrodes, respectively. Each film thickness regulating unit is configured to regulate a thickness of the high-temperature plasma raw material on the circumferential surface of the associated discharge electrode to a predetermined film thickness. Each film thickness regulating unit includes a film thickness regulating member that faces the circumferential surface of the associated discharge electrode with a predetermined gap, and a biasing member operable to bias the film thickness regulating member toward the circumferential surface of the associated discharge electrode. Each film thickness regulating unit also includes a control member operable to regulate a movement of the film thickness regulating member in a biasing direction of the biasing member such that a gap between the circumferential surface of the associated discharge electrode and the film thickness regulating member becomes equal to or greater than a value corresponding to the predetermined film thickness.

Each of the control members prevents a biasing force of the associated biasing member from bringing the film thickness regulating member into contact with the circumferential surface of the associated discharge electrode during rest of the discharge electrode and during a period from the beginning of rotation to steady rotation. Also, the gap between the circumferential surface of the discharge electrode and the associated film thickness regulating member is always (i.e., when the discharge electrode is in a rest state or stationary state, and from when the discharge electrode starts rotating to when its rotating speed reaches a steady speed) maintained to be a desired gap. During steady rotation of the discharge electrode, the biasing member regulates the movement of the film thickness regulating member in a direction of increase of the gap, which movement is caused by buoyance from the high-temperature plasma raw material on the discharge electrode, to thereby maintain the gap to have a desired value. Thus, it is possible to always maintain a desired film thickness of the high-temperature plasma raw material on the circumferential surface of the associated discharge electrode.

Each of the control members may be in point contact with the associated film thickness regulating member to regulate the movement of the associated film thickness regulating member. This configuration can reduce friction between the control member and the associated film thickness regulating member.

Each of the control members may be a hexagon socket set screw extending in the biasing direction of the associated biasing member. One end of each control member may be in contact with the associated film thickness regulating member to regulate the movement of the associated film thickness regulating member. This configuration can facilitate appropriate positioning of each film thickness regulating member. Also, the construction of each film thickness regulating member can be simplified when the hexagon socket set screw is used. This contributes to a reduction in cost.

According to the present invention, even if rotation and stoppage of the discharge electrodes are repeated, constant gaps between the circumferential surfaces of the discharge electrodes and the film thickness regulating members can be maintained. Therefore, it is possible to always maintain a desired thickness of the high-temperature plasma raw materials on the discharge electrodes.

These and other objects, aspects and advantages of the present invention will become apparent to a skilled person from the following detailed description when read and understood in conjunction with the appended claims and drawings.

DETAILED DESCRIPTION OF THE INVENTION

Now, embodiments of the present invention will be described with reference to the accompanying drawings. It should be noted that the present invention is not limited to the illustrated and described embodiments, and the embodiments of the present invention are not limited to the illustrated and described embodiments.

First Embodiment

Figure 1:
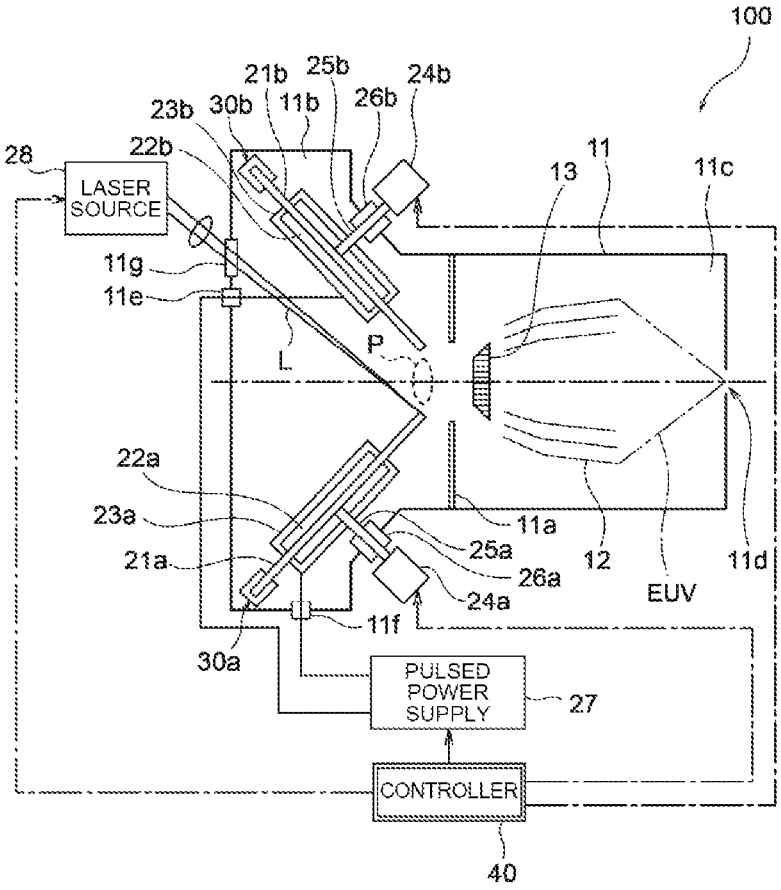
FIG. 1 is a schematic block diagram of an exemplary extreme ultraviolet light source device according to an embodiment of the present invention.

Referring to FIG. 1, an extreme ultraviolet light source device (EUV light source device) 100 according to this embodiment is a device for emitting extreme ultraviolet light (EUV light) having a wavelength of, for example, 13.5 nm. The light source device 100 may be used as a light source for emitting exposure light applied to a semiconductor device.

The EUV light source device 100 is a DPP type EUV light source device. More specifically, the EUV light source device 100 is a LDP type EUV light source device for irradiating a high-temperature plasma raw material, which is supplied onto an electrode surface, with an energy beam such as a laser beam to vaporize the high-temperature raw material and for subsequently generating high-temperature plasma by the electric discharge between the electrodes.

As shown in FIG. 1, the EUV light source device 100 has a chamber 11 that is used as a discharging container. The chamber 11 is generally partitioned into two spaces by a partition wall 11*a* having an opening defined therein. One of the two spaces is a discharging space 11*b* and the other is a condensing space 11*c*.

In the discharging space 11*b*, a pair of independently rotatable discharge electrodes 21*a* and 21*b* is disposed. The discharge electrodes 21*a* and 21*b* are spaced from each other. Each of the discharge electrodes 21*a* and 21*b* is a discharge member for heating and exciting a high-temperature plasma raw material including an EUV light emission seed (or seeds).

The discharging space 11*b* is maintained at a pressure of a vacuum atmosphere to satisfactorily generate electric discharge required to heat and excite the high-temperature plasma raw material.

In the condensing space 11*c*, an EUV condensing mirror 12 and a debris trap 13 are disposed.

The EUV condensing mirror 12 condenses EUV light, which is emitted upon heating and exciting the high-temperature plasma raw material, and introduces the condensed EUV light from an EUV outlet 11*d* defined in a wall of the chamber 11 to, for example, an irradiation system of an exposure device (not shown).

The EUV condensing mirror 12 is, for example, an oblique-incidence condensing mirror and has a construction in which a plurality of thin concave mirrors are disposed highly precisely in a nested form. Each concave mirror has a reflecting surface in the form of, for example, an ellipsoid of revolution, a paraboloid of revolution, or a Wolter shape. Each concave mirror is in the form of a body of revolution. The Wolter shape is a concave shape having a plane of light incidence made up of a hyperboloid of revolution and an ellipsoid of revolution or a hyperboloid of revolution and a paraboloid of revolution in order from the light incidence side.

The EUV condensing mirror 12 includes a plurality of concave mirrors each having a reflecting surface in the form of any one of an ellipsoid of revolution, a Wolter shape and the like. The concave mirrors are in the form of respective bodies of revolution having different diameters. The concave mirrors of the EUV condensing mirror 12 are disposed so as to have respective central axes of rotation aligned with one another on the same axis so that respective focal points may be located at substantially the same position. In this manner, the concave mirrors are highly precisely positioned in a nested form, thereby enabling the EUV condensing mirror 12 to satisfactorily reflect EUV light having an oblique-incidence angle of no greater than about 25 degrees and condense it at a point.

A material of a base substance of each concave mirror is, for example, nickel (Ni). In order to reflect EUV light having a very short wavelength, the reflecting surface of each concave mirror is shaped into an excellently smooth surface. A metallic film made of, for example, ruthenium (Ru), molybdenum (Mo), rhodium (Rh) or the like is formed on the smooth surface as a reflective material. The reflecting surface of each concave mirror is precisely coated with such a metallic film.

The debris trap 13 captures debris, which is generated as a result of generation of plasma by electric discharge, to hinder the debris from moving toward a condensing portion of the EUV light. The debris trap 13 captures the debris and only allows the EUV light to pass therethrough.

Each of the two discharge electrodes 21*a* and 21*b* disposed in the discharging space 11*b* is a disc-shaped metallic member. The discharge electrodes 21*a* and 21*b* are made of a high melting point metal such as, for example, tungsten, molybdenum, tantalum or the like. Of the two discharge electrodes 21*a* and 21*b*, one discharge electrode 21*a* is a cathode and the other discharge electrode 21*b* is an anode.

The discharge electrode 21*a* is disposed so as to be partly soaked in a high-temperature plasma raw material 22*a* reserved in a container 23*a*. The raw material 22*a* is liquid. A rotating shaft 25*a* of a motor 24*a* is rigidly secured to a nearly central portion of the discharge electrode 21*a*. That is, the discharge electrode 21*a* rotates as the rotating shaft 25*a* is caused to rotate by the motor 24*a*. The motor 24*a* is driven under the control of a controller 40.

Part of the rotating shaft 25*a* is received in the chamber 11 via, for example, a mechanical seal 26*a*. The mechanical seal 26*a* allows rotation of the rotating shaft 25*a* while maintaining a low pressure atmosphere within the chamber 11.

Similar to the discharge electrode 21*a*, the discharge electrode 21*b* is disposed so as to be partly soaked in a high-temperature plasma raw material 22*b* that is contained in a container 23*b*. The raw material 22*b* is liquid. A rotating shaft 25*b* of a motor 24*b* is rigidly secured to a nearly central portion of the discharge electrode 21*b*. That is, the discharge electrode 21*b* rotates as the rotating shaft 25*b* is caused to rotate by the motor 24*b*. The motor 24*b* is driven and controlled by the controller 40.

Part of the rotating shaft 25*b* is received in the chamber 11 via, for example, a mechanical seal 26*b*. The mechanical seal 26*b* allows rotation of the rotating shaft 25*b* while maintaining the low pressure atmosphere within the chamber 11.

The high-temperature plasma raw materials 22*a* and 22*b* in the form of a liquid placed on the surfaces of the discharge electrodes 21*a* and 21*b* are conveyed to a discharging region upon rotations of the discharge electrodes 21*a* and 21*b*, respectively.

In this specification, the discharging region is a space in which electric discharge occurs between the two electrodes 21*a* and 21*b* and the two electrodes 21*a* and 21*b* are positioned closest to each other. In this embodiment, the discharge electrodes 21*a* and 21*b* are disposed so as to allow respective circumferential portions (outer edge portions) of the discharge electrodes to be opposed to each other at a predetermined distance. Accordingly, in the discharging region, the distance between the circumferential portions of the discharge electrodes 21*a* and 21*b* is shortest.

A molten metal, such as tin (Sn) in the form of a liquid, is used as the high-temperature plasma raw materials 22*a* and 22*b*. The high-temperature plasm raw materials 22*a* and 22*b* also serve as power feeding electric conductors for supplying the discharge electrodes 21*a* and 21*b* with electricity.

The containers 23*a* and 23*b* are electrically connected to a pulsed power supply unit 27 via respective insulating power inlet portions 11*e* and 11*f*. The power inlet portions 11*e* and 11*f* can maintain the low pressure atmosphere within the chamber 11. The containers 23*a* and 23*b* and tin 22*a* and 22*b*, which is the high-temperature plasma raw materials, are electrically conductive. Because the discharge electrodes

21*a* and 21*b* are partly soaked in tin 22*a* and 22*b*, respectively, the discharge electrodes 21*a* and 21*b* are supplied with pulsed power by applying a pulsed voltage from the pulsed power supply unit 27 to the two containers 23*a* and 23*b*.

Although not shown in the drawings, the containers 23*a* and 23*b* are each provided with a temperature control mechanism to maintain tin 22*a* and 22*b* in a molten state.

The pulsed power supply unit 27 applies a pulsed voltage of a short pulse width across the containers 23*a* and 23*b*, i.e., the discharge electrodes 21*a* and 21*b*. The pulsed power supply unit 27 is driven and controlled by the controller 40.

A laser light source 28 is an energy beam irradiating unit for irradiating tin 22*a* on the discharge electrode 21*a*, which is conveyed to the discharging region, with laser light (energy beam). The laser light source 28 is, for example, an $Nd/YVO_4$ laser device (Neodymium-doped Yttrium Orthovanadate laser device). Laser light L emitted from the laser source 28 is incident on a window portion 11*g* of the chamber 11 via a laser light condensing element or the like and then introduced to the discharge electrode 21*a*. The irradiating timing of the laser light from the laser source 28 is controlled by the controller 40.

When the high-temperature plasma raw material 22*a* conveyed to the discharging region is irradiated with the laser light in a state where the discharge electrodes 21*a* and 21*b* are supplied with the pulsed power by the pulsed power supply unit 27, the high-temperature plasma raw material vaporizes and pulse discharge is commenced between the two discharge electrodes 21*a* and 21*b*. As a result, plasma P is formed by the high-temperature plasma raw materials 22*a* and 22*b*. When a large electric current flowing during electric discharge heats and excites the plasma P up to a high temperature, EUV light is emitted from the high-temperature plasma P.

As described above, because pulsed power is supplied between the discharge electrodes 21*a* and 21*b*, the above-mentioned electric discharge is pulse discharge and the EUV light so emitted is the pulsed light.

In this embodiment, film thickness regulating mechanisms (film thickness regulating unit) 30*a* and 30*b* are disposed in the vicinity of the discharge electrodes 21*a* and 21*b* respectively in order to regulate the thicknesses of the liquid high-temperature plasma raw materials 22*a* and 22*b* placed on the discharge electrodes 21*a* and 21*b* to a desired film thickness (for example, 10 μm).

If the high-temperature plasma raw material 22*a*, 22*b* in the liquid state on each electrode surface to be conveyed to the discharging region is too thin, an amount of raw material (low-temperature plasma) vaporized or generated upon irradiation of the energy beam such as a laser beam is insufficient. When high-temperature plasma is subsequently generated by electric discharge, the intensity (density) of the plasma becomes insufficient. Accordingly, EUV light having a desired intensity cannot be taken out from the plasma.

On the other hand, if the high-temperature plasma raw material 22*a*, 22*b* is too thick, a centrifugal force generated during rotation of the discharge electrode 21*a*, 21*b* scatters a portion of the high-temperature plasma raw material 22*a*, 22*b* on the discharge electrode 21*a*, 21*b*. The high-temperature plasma raw material 22*a*, 22*b* so scattered turns into debris. The debris may adhere to undesired portions within the EUV light source device 100. Also, if the high-temperature plasma raw material 22*a*, 22*b* is too thick and irradiated with an energy beam such as a laser beam or the like, a vaporized raw material (low-temperature plasma) is excessively generated. At the time of subsequent generation of high-temperature plasma by electric discharge, the density of plasma becomes too high and, hence, it is likely that EUV light emitted from the plasma is partly absorbed by the high-density plasma and/or light that has a wavelength other than the wavelength of the EUV light is emitted from the plasma in a large quantity.

For the above-described reasons, the high-temperature plasma raw material 22*a*, 22*b* in the liquid state on each electrode surface to be conveyed to the discharging region must be regulated to have a desired thickness.

The film thickness regulating mechanisms 30*a* and 30*b* will now be described in detail. It should be noted that the film thickness regulating mechanism 30*a* associated with the discharge electrode 21*a* and the film thickness regulating mechanism 30*b* associated with the discharge electrode 21*b* have the same construction, and therefore only the film thickness regulating mechanism 30*a* associated with the discharge electrode 21*a* will be described below.

Figure 2:
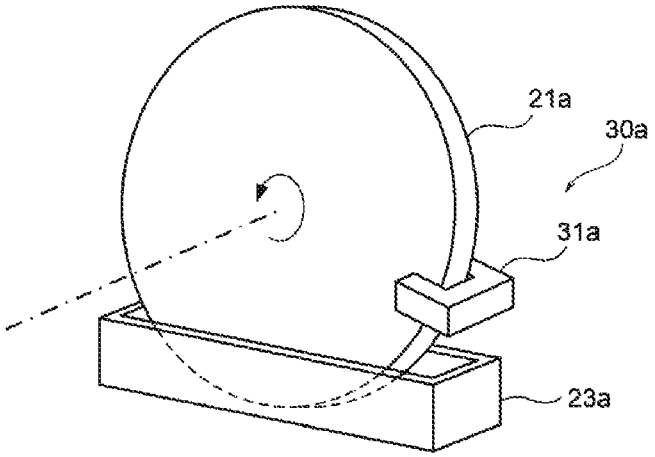
FIG. 2 is a perspective view of a film thickness regulating mechanism, particularly depicting an installation position of a skimmer.

As shown in FIG. 2, the film thickness regulating mechanism 30*a* has a film thickness regulating member (hereinafter referred to as a "skimmer") 31*a* for encircling a portion of a circumferential portion of the discharge electrode 21*a*. The skimmer 31*a* is made of a material such as, tungsten, molybdenum or the like that is inactive against tin 22*a*, i.e., the high-temperature plasma raw material.

The skimmer 31*a* has a recess defined therein to form a gap (clearance) between the skimmer 31*a* and the discharge electrode 21*a*. The skimmer 31*a* has a generally U shape to define the recess or the gap. The gap corresponds to the desired thickness of the plasma material 22*a* on the discharge electrode 21*a*. The gap is defined between opposite inner side surfaces of the U shape of the skimmer 31*a* and two opposite disc-shaped surfaces of the discharge electrode 21*a*. The gap is also defined between the inner bottom of the recess (U shape) of the skimmer 31*a* and a circumferential surface (curved surface, edge surface) of the discharge electrode 21*a*. The circumferential surface of the discharge electrode 21*a* lies between the two opposite disc-shaped surfaces of the discharge electrode 21*a*. The inner bottom of the U-shaped skimmer 31*a* faces the circumferential surface of the discharge electrode 21*a*. Thus, during rotation of the discharge electrode 21*a*, when the high-temperature plasma raw material 22*a* adhering to the discharge electrode 21*a* passes through the skimmer 31*a*, the thickness of the high-temperature plasma raw material 22*a* on the circumferential surface of the discharge electrode 21*a* is regulated to a thickness corresponding to the above-mentioned gap.

In that region on the discharge electrode 21*a* which is irradiated with the laser light L, the skimmer 31*a* is located at a position where the high-temperature plasma raw material 22*a* is regulated to have the desired thickness. Also, the skimmer 31*a* is supported by, for example, one or more springs in the horizontal direction and in the direction of gravitational force. That is, the skimmer 31*a* is supported so as to maintain the gap to be equal to a size corresponding to the desired film thickness during rotation of the discharge electrode 21*a* and also during rest of the discharge electrode 21*a*.

Figure 3:
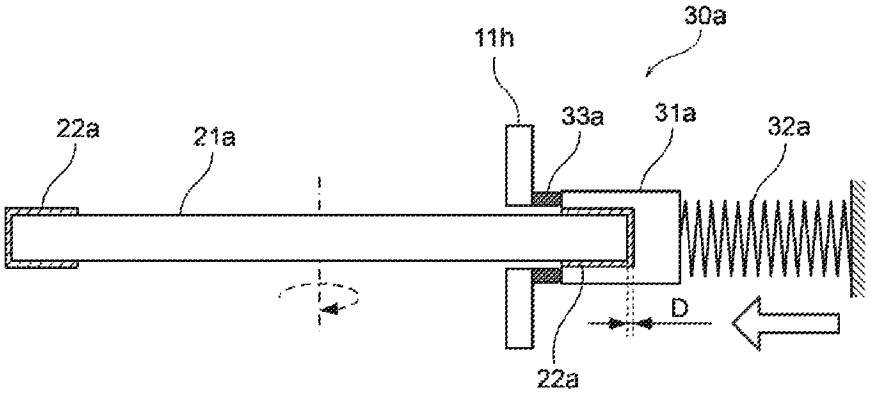
FIG. 3 illustrates the film thickness regulating mechanism, particularly depicting a construction thereof.

FIG. 3 illustrates a configuration of the film thickness regulating mechanism 30*a*. As shown in FIG. 3, the film thickness regulating mechanism 30*a* has the skimmer 31*a*, a spring 32*a*, and a pair of stoppers 33*a*.

The spring 32*a* is a biasing member for biasing the skimmer 31*a* in a direction in which the skimmer 31*a* approaches the circumferential surface of the discharge electrode 21*a* (in the direction of the white arrow in FIG. 3). The spring 32*a* has one end secured to the skimmer 31*a* and the other end secured to, for example, the chamber 11. A biasing force of the spring 32*a* is set to a value such that a desired film thickness D is formed by the gap between the circumferential surface of the discharge electrode 21*a* and the inner bottom surface of the recess in the skimmer 31*a* during the normal or steady rotation of the discharge electrode 21*a* (when the discharge electrode 21*a* is rotating at the maximum speed). The spring 32*a* is a resilient element.

The stoppers 33*a* are disposed on an opposite side of the spring 32*a* across the skimmer 31*a*. Each of the stoppers 33*a* is secured to a support member 11*h* at one end thereof. The support member 11*h* is secured to, for example, the chamber 11. The opposite end of each stopper 33*a*, which faces the skimmer 31*a*, is a contact portion that is suitable for contact with the skimmer 31*a*. This end of the stopper 33*a* is referred to as a distal end. The stopper 33*a* is a control member for regulating a movement of the skimmer 31*a* in a biasing direction of the spring 32*a* such that the stopper 33*a* does not allow the gap between the circumferential surface of the discharge electrode 21*a* and the skimmer 31*a* to be less than a value corresponding to the desired film thickness D.

The distal end of the stopper 33*a* has, for example, a spherical shape so as to be held in point contact with the skimmer 31*a*. It should be noted, however, that the stopper 33*a* may have a distal end in the form of, for example, a planar shape. A hexagon socket set screw (hexagon socket set screw having no head) or the like made of, for example, stainless steel can be used as the stopper 33*a*. In this case, the hexagon socket set screw having no head, i.e., the stopper 33*a*, may extend in the biasing direction of the spring 32*a* to regulate the movement of the skimmer 31*a* by holding the distal end of the set screw 33*a* in contact with the skimmer 31*a*.

Figure 4:
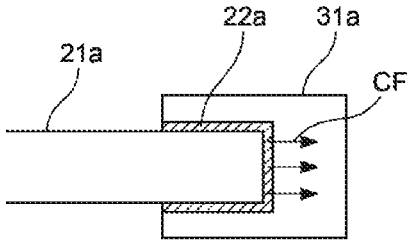
FIG. 4 is a view useful to describe a centrifugal force generated when a discharge electrode rotates.

As shown in FIG. 4, rotation of the discharge electrode 21*a* applies a centrifugal force CF to the liquid tin 22*a* on the discharge electrode 21*a* in a direction of arrows. In this event, the skimmer 31*a* receives a force from the high-temperature plasma raw material in the form of a liquid, i.e., tin 22*a*, in the direction of the arrows under the influence of the centrifugal force CF. That is, the skimmer 31*a* receives buoyancy from tin 22*a* in a direction in which the distance between the skimmer 31*a* and the circumferential surface of the discharge electrode 21*a* increases.

In general, a centrifugal force acting on a rotating body is proportional to a square of an angular velocity co of the rotating body. Thus, the force received by the skimmer 31*a* from tin 22*a* during rotation of the discharge electrode 21*a* is maximized at the time of steady rotation during which the rotating speed of the discharge electrode 21*a* is the highest.

If the skimmer 31*a* is held freely, the skimmer 31*a* moves rightward in FIG. 4 by a length corresponding to the buoyancy. That is, with an increase in the rotating speed of the discharge electrode 21*a*, the gap between the circumferential surface of the discharge electrode 21*a* and the inner bottom surface of the recess in the skimmer 31*a* increases. Thus, the thickness of tin 22*a* on the circumferential surface of the discharge electrode 21*a* becomes greater than the desired film thickness D.

The discharge electrode 21*a* is heated with repetition of discharging operations and expands radially due to thermal expansion. If the skimmer 31*a* is rigidly held so as to fix a positional relationship between the skimmer 31*a* and the discharge electrode 21*a*, the thermal expansion of the discharge electrode 21*a* reduces the gap between the circumferential surface of the discharge electrode 21*a* and the inner bottom surface of the recess in the skimmer 31*a*. This causes the thickness of tin 22*a* on the discharge electrode 21*a* to become thinner than the desired film thickness D. Because the desired film thickness D of tin 22*a* is as thin as, for example, 10 μm, the thermal expansion may incur a risk that the circumferential surface of the discharge electrode 21*a* is brought into contact with the inner bottom surface of the recess in the skimmer 31*a*. In some cases, the rotating discharge electrode 21*a* may be disadvantageously subjected to an undesired braking force from the skimmer 31*a*.

On the contrary, in this embodiment, the skimmer 31*a* is elastically held (supported) by the spring 32*a* that is an elastic member. A biasing force of the spring 32*a* is set to a value such that the desired film thickness D is formed by the gap between the circumferential surface of the discharge electrode 21*a* and the inner bottom surface of the recess in the skimmer 31*a*, during steady (normal) rotation of the discharge electrode 21*a*. Accordingly, even if a centrifugal force generated by rotations of the discharge electrode 21*a* causes the skimmer 31*a* to be subjected to buoyancy, the gap between the skimmer 31*a* and the circumferential surface of the discharge electrode 21*a* can be maintained to the desired film thickness D. Also, even if repetition of the discharging operations causes thermal expansion of the discharge electrode 21*a*, the contact between the circumferential surface of the discharge electrode 21*a* and the inner bottom surface of the recess in the skimmer 31*a* can be avoided.

Figure 5:
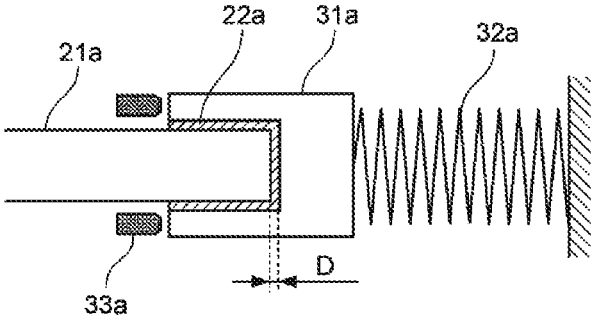
FIG. 5 illustrates the skimmer during steady rotation of the discharge electrode.

Specifically, during steady rotation to obtain a predetermined output of EUV light, the discharge electrode 21*a* itself is heated through repetition of the discharging operations, as described above, to thereby cause thermal expansion of the discharge electrode 21*a*. As a result, as shown in FIG. 5, the skimmer 31*a* moves away from the stoppers 33*a* by a length corresponding to the thermal expansion of the discharge electrode 21*a*, but the spring 32*a* acts to hold the skimmer 31*a* at a position where the gap between the skimmer 31*a* and the circumferential surface of the discharge electrode 21*a* becomes equal to the desired film thickness D.

Figure 6:
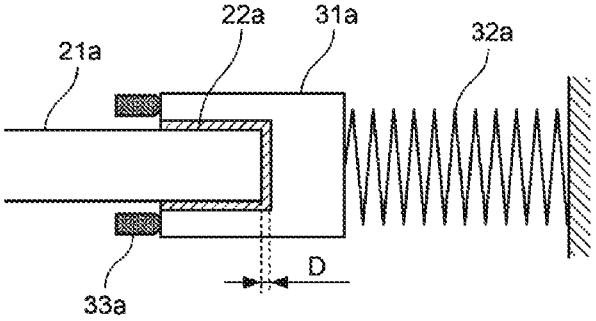
FIG. 6 illustrates the skimmer at the beginning of rotation.

In applications where the discharge electrode 21*a* is low in temperature and not greatly affected by the thermal expansion at the beginning of steady operation, the skimmer 31*a* is held at a position where it is in contact with the stoppers 33*a*, as shown in FIG. 6. In this case also, the gap between the skimmer 31*a* and the circumferential surface of the discharge electrode 21*a* becomes equal to the desired film thickness D.

As described above, the biasing force of the spring 32*a* is set to a value such that the desired film thickness D is formed by the gap between the circumferential surface of the discharge electrode 21*a* and the inner bottom surface of the recess in the skimmer 31*a*, during steady rotation of the discharge electrode 21*a*. Thus, the skimmer 31*a* is held at a position such that the gap between the skimmer 31*a* and the circumferential surface of the discharge electrode 21*a* becomes equal to the desired film thickness D during steady rotation of the discharge electrode 21*a*.

During rest of the discharge electrode 21*a* and in a state where the rotating speed of the discharge electrode 21*a* is relatively slow at the beginning of rotation of the discharge electrode 21*a*, or the like, the biasing force of the spring 32*a* is greater than the centrifugal force. Thus, the inner bottom surface of the recess in the skimmer 31*a* is subjected to a force that causes the skimmer 31*a* to approach the circumferential surface of the discharge electrode 21*a*. However, the stoppers 33*a* act to hold the skimmer 31*a* at the position of contact between the stoppers 33*a* and the skimmer 31*a*, as shown in FIG. 6. In this case also, the gap between the skimmer 31*a* and the circumferential surface of the discharge electrode 21*a* becomes equal to the desired film thickness D.

As described above, the film thickness regulating mechanism 30*a* always maintains the gap between the circumferential surface of the discharge electrode 21*a* and the inner bottom surface of the recess in the skimmer 31*a* to be equal to a value corresponding to the desired film thickness D irrespective of the degree of thermal expansion or the rotating speed of the discharge electrode 21*a*. Therefore, it is possible to maintain the desired film thickness D of tin 22*a* on the circumferential surface of the discharge electrode 21*a*.

For easier understanding of the advantages of the above-described embodiment, a comparative example will be described below with reference to FIG. 7 to FIG. 12. A film thickness regulating mechanism of the comparative example has no control members corresponding to the stoppers 33*a* of the above-described embodiment.

Figure 7:
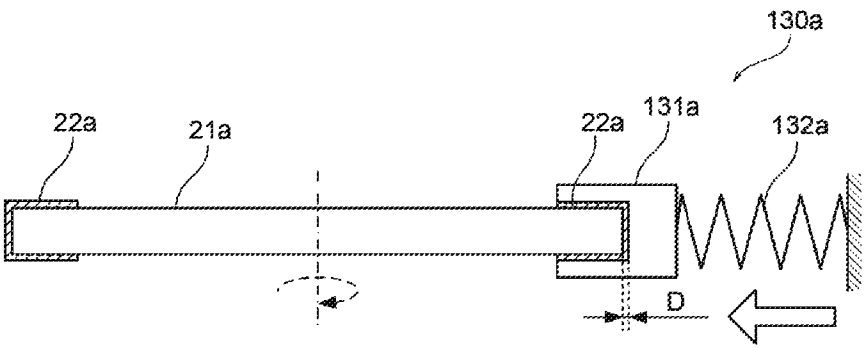
FIG. 7 depicts a comparative example of a film thickness regulating mechanism.

As shown in FIG. 7, the film thickness regulating mechanism 130*a* of the comparative example includes a skimmer 131*a* and a spring 132*a*. The skimmer 131*a* has the same construction as the skimmer 31*a* according to the embodiment of the present invention. Similar to the spring 32*a* according to the embodiment of the present invention, the spring 132*a* biases the skimmer 131*a* in a direction in which the skimmer 131*a* approaches the circumferential surface of the discharge electrode 21*a* (in the direction of the white arrow in FIG. 7). It is assumed that a biasing force of the spring 132*a* is set to a value such that the desired film thickness D is formed by the gap between the skimmer 131*a* and the circumferential surface of the discharge electrode 21*a* during steady rotation of the discharge electrode 21*a*.

Figure 8:
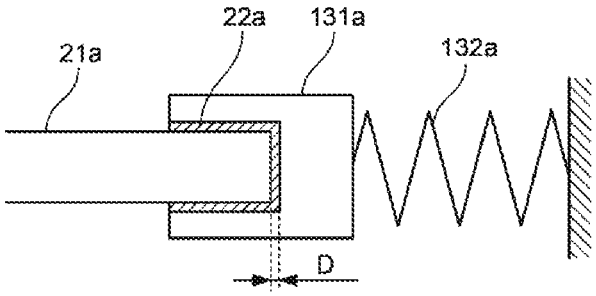
FIG. 8 depicts a skimmer of the comparative example during steady rotation of the discharge electrode.

As shown in FIG. 8, the gap between the skimmer 131*a* and the circumferential surface of the discharge electrode 21*a* becomes equal to the desired film thickness D while the discharge electrode 21*a* is rotating at a steady speed (maximum speed). Accordingly, the film thickness of tin 22*a* on the circumferential surface of the discharge electrode 21*a* becomes equal to the desired film thickness D.

Figure 9:
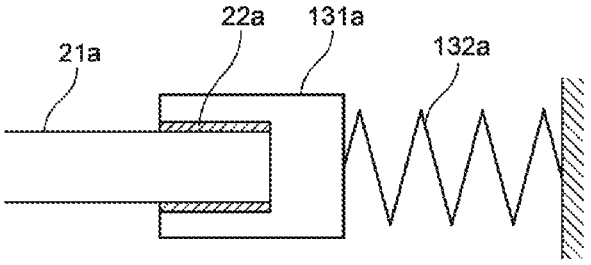
FIG. 9 depicts the skimmer of the comparative example at the beginning of rotation.

However, the biasing force of the spring 132*a* is greater than a centrifugal force acting on tin 22*a* (buoyancy acting on the skimmer 131*a*) when the discharge electrode 21*a* is in a stationary state and also while the rotating speed of the discharge electrode 21*a* is between zero and the maximum speed. Thus, as shown in FIG. 9, the inner bottom surface of the recess in the skimmer 131*a* contacts the circumferential surface of the discharge electrode 21*a* at the beginning of rotation of the discharge electrode 21*a*. Accordingly, as the EUV light source device is activated and deactivated repeatedly (that is, rotating and stopping of the discharge electrode 21*a* are repeated), the skimmer 131*a* abrades gradually through contact thereof with the discharge electrode 21*a* at the beginning of rotation.

Figure 10:
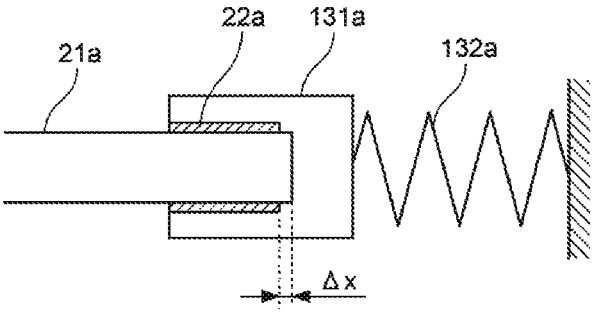
FIG. 10 illustrates an abraded state of the skimmer of the comparative example.

As the abrasion of the skimmer 131*a* progresses, as shown in FIG. 10, the length of the spring 132*a* when the skimmer 131*a* is held in contact with the circumferential surface of the discharge electrode 21*a* increases by an abrasion loss $\Delta x$ of the skimmer 131*a* compared with that before abrasion. That is, the biasing force of the spring 132*a* pressing the skimmer 131*a* decreases.

Figure 11:
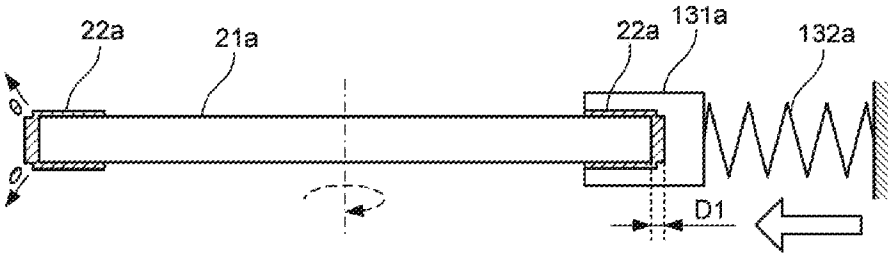
FIG. 11 is a view useful to describe a problem inherent in a film thickness regulating mechanism of the comparative example.

When the force of the spring 132*a* pressing the skimmer 131*a* becomes less than the buoyancy caused by the centrifugal force of tin 22*a*, as shown in FIG. 11, the thickness of tin 22*a* on the circumferential surface of the discharge electrode 21*a* during steady rotation of the discharge electrode 21*a* becomes a film thickness D1 that is greater than the desired film thickness D. An increase in thickness of tin 22*a* on the circumferential surface of the discharge electrode 21*a* is likely to cause the centrifugal force to scatter a portion of tin 22*a* from the discharge electrode 21*a* during rotation of the discharge electrode 21*a*. Tin 22*a* so scattered turns into debris, which may adhere to undesired portions within the EUV light source device. Such tin 22*a* may cause a short circuit between the two electrodes 21*a* and 21*b*.

Figure 12:
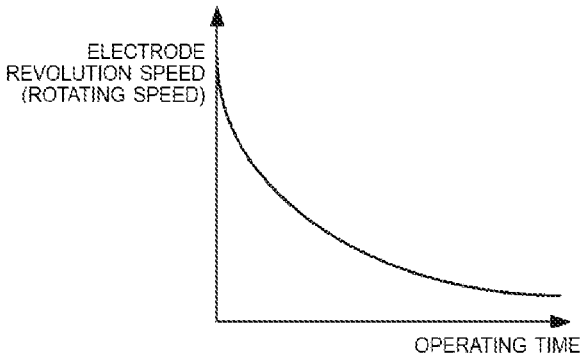
FIG. 12 is a view useful to describe a change in the electrode rotating speed of the comparative example.

In order to avoid the above-described scattering of tin 22*a* upon the abrasion of the skimmer 131*a*, the rotating speed of the discharge electrode 21*a* must be reduced. That is, in the comparative example, as shown in FIG. 12, the revolution speed (rotating speed) of the discharge electrode 21*a* during steady rotation must be reduced with an increase in operating time of the EUV light source device.

However, a reduction in the rotating speed of the discharge electrode 21*a* reduces the distance between a laser beam irradiation position on the discharge electrode 21*a* at a certain point in time and that on the discharge electrode 21*a* at the time of the next EUV generating operation. If this distance is reduced, a sufficient amount of tin 22*a* does not exist on the irradiation position on the discharge electrode 21*a* at the time of the laser beam irradiation of the next EUV generating operation. This may deteriorate the EUV emission performances.

The abrasion progresses from the state shown in FIG. 9 when the discharge electrode 21*a* contacts the skimmer 131*a*. FIG. 10 shows the abrasion at a certain point in time. It should also be noted here that the abrasion does not always progress smoothly. In other words, the inner bottom surface of the recess in the skimmer 131*a* does not necessarily abrade in parallel to the circumferential surface of the discharge electrode 21*a*. For example, as shown in FIG. 13, the skimmer 131*a* may be brought into contact with the discharge electrode 21*a*, with the skimmer 131*a* being inclined relative to the discharge electrode 21*a*.

Figure 13:
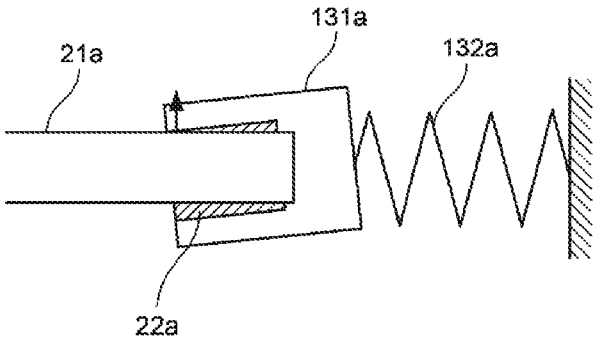
FIG. 13 is a view useful to describe another problem inherent in the film thickness regulating mechanism of the comparative example.

In the case of FIG. 13, the discharge electrode 21*a* receives an undesired braking force from the skimmer 131*a*. Thus, the discharge electrode 21*a* is reduced in the rotating speed, and/or abrasion of the skimmer 131*a* occurs in a direction of the arrow in FIG. 13 (direction parallel to an axis of rotation of the discharge electrode 21*a*). Such abrasion causes the gap between the skimmer 131*a* and the discharge electrode 21*a* to become greater than a set value (desired film thickness D) and makes the above-described defects (scattering of tin 22*a*, deterioration of the EUV emission performances, and the like) more conspicuous.

On the contrary, the film thickness regulating mechanism 30*a* according to the embodiment of the present invention includes the skimmer 31*a* disposed so as to confront the circumferential surface (curved surface) of the discharge electrode 21*a* with a gap (clearance) corresponding to the desired film thickness D, the spring 32*a* for applying a biasing force to the skimmer 31*a* in a direction in which the skimmer 32*a* approaches the circumferential surface of the discharge electrode 21*a*, and the two stoppers 33*a* for regulating the movement of the skimmer 31*a* in the biasing direction of the spring 32*a* so as not to allow the gap between the skimmer 31*a* and the discharge electrode 21*a* to become less than a value corresponding to the desired film thickness D.

This configuration ensures that the skimmer 31*a* is not brought into contact with the discharge electrode 21*a* not only at the beginning of rotation of the discharge electrode 21*a* but also during steady rotation of the discharge electrode 21*a*. In addition, this configuration can maintain the gap between the discharge electrode 21*a* and the skimmer 31*a* to have a value corresponding to the desired film thickness D.

In this manner, because the discharge electrode 21*a* is not brought into contact with the skimmer 31*a* at the beginning of rotation (including the time of rest), abrasion of the skimmer 31*a* can be inhibited. Also, the gap between the discharge electrode 21*a* and the skimmer 31*a* does not increase due to a reduction in the biasing force of the spring 32*a* caused by the abrasion of the skimmer 31*a*. Accordingly, undesired scattering of tin 22*a* as shown in FIG. 11 does not occur.

In order to inhibit the scattering of tin 22*a*, there is no need to reduce the rotating speed of the electrode during steady rotation. Thus, it is possible to avoid deterioration of the EUV emission performances and realize stable EUV emission.

Because the skimmer 31*a* can maintain a stable posture with respect to the discharge electrode 21*a* in a state where both of them are not in contact with each other, it is possible to prevent the skimmer 31*a* from contacting (interfering with) the discharge electrode 21*a* in an abnormal posture as shown in FIG. 13. Accordingly, the defects (e.g., a reduction in the rotating speed of the discharge electrode 21*a*, which is caused by contact (interference) between the discharge electrode 21*a* and the skimmer 31*a*) can be avoided.

Because the stoppers 33*a* are provided for regulating the movement of the skimmer 31*a* to maintain the gap between the skimmer 31*a* and the discharge electrode 21*a*, a spring having an elastic force greater than that of the spring 132*a* according to the above-described comparative example can be employed as a spring 32*a* for biasing the skimmer 31*a*.

Even if the elastic force of the spring 32*a* is increased and a relatively strong force is applied to the skimmer 31*a* from the spring 32*a* in a direction in which the spring 32*a* biases the skimmer 31*a* toward the discharge electrode 21*a*, the stoppers 33*a* are able to regulate the movement of the skimmer 31*a* so as not to move the skimmer 31*a* to a position where the gap is reduced to below a desired value. Thus, in applications where thermal expansion of the discharge electrode 21*a* is negligible, a spring having an elastic force greater than that of the spring 132*a* according to the above-described comparative example can be employed. This makes it possible to sufficiently cope with a change in centrifugal force and increase the rotating speed of the discharge electrode 21*a*.

Because the distal end of each of the stoppers 33*a* has the spherical shape and is held in point contact with the skimmer 31*a*, friction between the stoppers 33*a* and the skimmer 31*a* is small. Also, the use of a hexagon socket set screw (hexagon socket set screw having no head) as each stopper 33*a* can facilitate appropriate positioning of the skimmer 31*a*, and the gap between the discharge electrode 21*a* and the skimmer 31*a* can be regulated to a desired value. Further, the configuration of the EUV light source device 100 can be simplified, resulting in a reduction in cost.

As described above, even if the discharge electrode 21*a* is caused to rotate and suspend repeatedly, the EUV light source device 100 of the above-described embodiment has no contact between the skimmer 31*a* and the discharge electrode 21*a* and can maintain a desired film thickness D of a high-temperature plasma raw material (tin) 22*a* in the form of a liquid on the discharge electrode 21*a*.

Although in the above-described embodiment the laser beam is used as an energy beam for irradiating a high-temperature plasma raw material, an ion beam, an electron beam or the like may be used in place of the laser beam.

Although in the above-described embodiment the EUV light source device 100 is used to emit exposure light to be applied to a semiconductor device, the present invention is not limited in this regard. For example, the EUV light source device 100 may be used as a light source for exposure mask inspection equipment or the like.

While certain embodiments have been described in the foregoing, these embodiments have been presented by way of example only, and are not intended to limit the scope of the present invention. The novel devices and methods thereof described herein may be embodied in a variety of other forms. Furthermore, various omissions, substitutions, changes and modifications may be made to the above-described embodiments without departing from the gist of the present invention. The accompanying claims and their equivalents are intended to cover such forms or modifications as would fall within the scope and gist of the present invention.

The present application is based upon and claims the benefit of a priority from Japanese Patent Application No. 2015-74231 filed Mar. 31, 2015, and the entire contents of which are incorporated herein by reference.

What is claimed is:

1. A light source device for emitting extreme ultraviolet light from plasma, comprising:

a pair of disc-shaped rotatable discharge electrodes spaced from each other, each said disc-shaped rotatable discharge electrode having opposite circular surfaces and a circumferential surface lying between the opposite circular surfaces;

a power supply unit configured to supply the pair of discharge electrodes with pulsed power;

a pair of containers associated with the pair of discharge electrodes, respectively, each said container being configured to contain a high-temperature plasma raw material therein, the raw material being a liquid raw material;

a pair of raw material supply units associated with the pair of containers, respectively, each said raw material supply unit being configured to supply the high-temperature plasma raw material from the associated container onto the associated discharge electrode by allowing a portion of the associated discharge electrode to pass through the high-temperature plasma raw material in the associated container upon rotations of the discharge electrode concerned;

an energy beam irradiating unit configured to irradiate the high-temperature plasma raw material on the circumferential surface of one of said pair of discharge electrodes with an energy beam to vaporize the high-temperature plasma raw material such that electric discharge takes place between said pair of discharge electrodes to generate the plasma; and a pair of film thickness regulating units associated with the pair of discharge electrodes, respectively, each said film thickness regulating unit being configured to regulate a thickness of the high-temperature plasma raw material on the circumferential surface of the associated discharge electrode to a predetermined film thickness, each said film thickness regulating unit including:

a film thickness regulating member that faces the circumferential surface of the associated discharge electrode with a predetermined gap;

a biasing member operable to bias the film thickness regulating member toward the circumferential surface of the associated discharge electrode; and a control member operable to limit a movement of the film thickness regulating member biased by the biasing member in a biasing direction of the biasing member such that a gap between the circumferential surface of the associated discharge electrode and the film thickness regulating member becomes equal to or greater than a value corresponding to the predetermined film thickness, wherein the control member and the biasing member are disposed on opposite sides of the film thickness regulating member, respectively.

2. The light source device according to claim 1, wherein the control member is in point contact with the film thickness regulating member to limit the movement of the film thickness regulating member.

3. The light source device according to claim 1, wherein the control member includes a hexagon socket set screw that extends in the biasing direction of the biasing member, and an end of the hexagon socket set screw contacts the film thickness regulating member to limit the movement of the film thickness regulating member.

4. The light source device according to claim 2, wherein the control member includes a hexagon socket set screw that extends in the biasing direction of the biasing member, and an end of the hexagon socket set screw contacts the film thickness regulating member to limit the movement of the film thickness regulating member.

5. The light source device according to claim 1, wherein the energy beam irradiating unit includes a laser device, and the energy beam emitted from the energy beam irradiating unit is a laser beam.

6. The light source device according to claim 1, wherein each said discharge electrode is made from a metal having a high melting point.

7. The light source device according to claim 1 further comprising a chamber configured to house said pair of discharge electrodes, wherein the chamber has a reduced pressure therein.

8. The light source device according to claim 1, wherein the plasma raw material includes liquid tin.

9. The light source device according to claim 1 further comprising a pair of temperature adjusting units associated with said pair of containers, respectively, wherein each said temperature adjusting unit is configured to adjust a temperature of the associated container.

10. The light source device according to claim 1, wherein the desired film thickness is 10 micrometers.

11. The light source device according to claim 1, wherein the film thickness regulating member includes a skimmer.

12. The light source device according to claim 1, wherein the biasing member includes a spring.

13. The light source device according to claim 1, wherein a biasing force of the biasing member is decided such that the film thickness regulating unit regulates the thickness of the high-temperature plasma raw material to the predetermined film thickness when the discharge electrode rotates at a maximum rotating speed.

14. The light source device according to claim 1, wherein the biasing member applies a biasing force to the film thickness regulating member to counterbalance a centrifugal force of the plasma raw material generated upon rotations of the discharge electrode.

15. The light source device according to claim 1, wherein the biasing member is a resilient member, and the film thickness regulating member is supported by the biasing member.

16. The light source device according to claim 1, wherein the control member does not contact the film thickness regulating member when the associated discharge electrode thermally expands.

17. The light source device according to claim 1, wherein the film thickness regulating member has a generally U shape.

18. The light source device according to claim 1, wherein the predetermined gap is equal to the predetermined film thickness.

* * * * *